US009757788B2

(12) United States Patent
Gane et al.

(10) Patent No.: US 9,757,788 B2
(45) Date of Patent: Sep. 12, 2017

(54) METHOD AND APPARATUS FOR HOT FORMING METAL PARTS

(71) Applicant: The Boeing Company, Chicago, IL (US)

(72) Inventors: David Howard Gane, Seattle, WA (US); Donald L. Conaway, Gig Harbor, WA (US); Duane Michael Hill, Milton, WA (US); Lonny D. Walz, Enumclaw, WA (US); Justin Michael Poirier, Buckley, WA (US); Anthony David Martinez, Black Diamond, WA (US); Jeffrey N. Repsumer, Enumclaw, WA (US)

(73) Assignee: THE BOEING COMPANY, Chicago, IL (US)

( * ) Notice: Subject to any disclaimer, the term of this patent is extended or adjusted under 35 U.S.C. 154(b) by 90 days.

(21) Appl. No.: 14/706,487

(22) Filed: May 7, 2015

(65) Prior Publication Data

US 2016/0325331 A1 Nov. 10, 2016

(51) Int. Cl.

| | |
|---|---|
| ***B21D 22/02*** | (2006.01) |
| ***B21D 37/16*** | (2006.01) |
| ***B21D 5/02*** | (2006.01) |
| ***B21D 11/02*** | (2006.01) |
| ***B21D 5/06*** | (2006.01) |
| ***B21D 53/78*** | (2006.01) |
| *B21D 25/02* | (2006.01) |
| *B21D 53/92* | (2006.01) |

(52) U.S. Cl.

CPC ..... *B21D 37/16* (2013.01); *B21D 5/06* (2013.01); *B21D 11/02* (2013.01); *B21D 53/78* (2013.01); *B21D 25/02* (2013.01); *B21D 53/92* (2013.01); *Y10T 29/49336* (2015.01)

(58) Field of Classification Search

CPC ..... B21D 11/02; B21D 11/10; B21D 22/022; B21D 25/00; B21D 25/02; B21D 25/04; B21D 37/16; B21D 53/78; B21D 53/92; Y10T 29/49332; Y10T 29/49336; Y10T 29/49339

USPC ..... 72/292, 342.7, 342.92, 364, 379.2, 392; 29/889.6, 889.7, 889.72

See application file for complete search history.

(56) References Cited

U.S. PATENT DOCUMENTS

| | | | | |
|---|---|---|---|---|
| 5,144,825 | A | 9/1992 | Burg et al. | |
| 5,323,631 | A * | 6/1994 | Weykamp | B21D 25/02 72/296 |
| 6,171,037 | B1 * | 1/2001 | Andre | B60P 3/075 410/10 |
| 6,598,866 | B2 | 7/2003 | Helm et al. | |

(Continued)

FOREIGN PATENT DOCUMENTS

WO 0016925 A1 3/2000

*Primary Examiner* — Peter DungBa Vo
*Assistant Examiner* — Joshua D Anderson
(74) *Attorney, Agent, or Firm* — Yee & Associates, P.C.

(57) ABSTRACT

A metal part is hot formed by placing a metal part blank on a forming tool and installing a fabric cover over the forming tool, overlying the metal part blank. The fabric is at least partially wrapped around the metal part blank. The metal part blank is heated to a temperature sufficient to allow forming of the metal part blank. Forming pressure is applied to the metal part blank that conforms the metal part blank to the forming tool by tensioning the fabric.

21 Claims, 8 Drawing Sheets

(56) References Cited

U.S. PATENT DOCUMENTS

| | | | | |
|---|---|---|---|---|
| 7,340,933 | B2 * | 3/2008 | Stewart | B21D 25/02 72/296 |
| 8,432,290 | B2 * | 4/2013 | Ruan | B60P 7/0861 340/665 |
| 8,783,624 | B2 | 7/2014 | Koppelman et al. | |
| 8,847,758 | B2 * | 9/2014 | Eide | B60P 7/0861 24/31 R |
| 2012/0114494 | A1 | 5/2012 | Ford et al. | |
| 2013/0133393 | A1 * | 5/2013 | Xu | B21D 1/12 72/292 |

* cited by examiner

METHOD AND APPARATUS FOR HOT FORMING METAL PARTS

BACKGROUND INFORMATION

1. Field

The present disclosure generally relates to metal forming, and deals more particularly with a method and apparatus for hot forming metal parts such as leading edges of airfoils.

2. Background

A process referred to as hot forming is sometimes used to form part blanks, such as metal sheets, into precise part geometries with smooth surface finishes. For example, in the aircraft industry, leading edges of airfoils such as wings and stabilizers are required to have exceptionally smooth surfaces, free of scratches, roughness and waviness in order to reduce boundary layer turbulence that causes undesirable drag. In some cases, turbulence may be further reduced by providing the airfoil with perforations in the leading edges which allow the air layer near the surface of the airfoil to be drawn in through the airfoil surface and subsequently vented to the atmosphere. The hot forming process is desirable because it does not adversely affect surface smoothness or distort airfoil perforations.

In the past, the leading edges of airfoils were hot formed using vacuum pressure and bagging film. A preformed part blank was placed on a heated, mandrel-like tool having an internal vacuum cavity. An insulation blanket was draped over the part blank, following which bagging film was installed over the insulation blanket and sealed around the tool, forming an internal vacuum chamber over the part blank. The tool was heated to a temperature sufficient to relax the part blank and allow it to be formed. A vacuum was then drawn beneath the bagging film, causing pressure to be applied to the part blank which formed the blank down over the tool. The insulation blanket insulated the hot part blank from the bagging film to prevent the bagging film from melting. This technique had a number of disadvantages. The installation and sealing the bagging film is time-consuming and labor-intensive. Additionally, the high forming temperature and applied vacuum pressure caused the insulation blanket to break down into dust-like particles which spread and settled over equipment, requiring labor-intensive cleanup. In addition, both the bagging film and the blankets are consumables which add to recurring expenses.

Accordingly, there is a need for a method and apparatus for hot forming metal parts such as leading edge airfoil skins which reduce recurring consumable costs and labor, while increasing production rates.

SUMMARY

The disclosed embodiments provide a method and apparatus for hot forming metal parts such as leading edge skins for airfoils, including those that are perforated to reduce turbulence and accompanying drag. The embodiments permit contouring of large metal parts from blank metal sheets, such as, without limitation, perforated titanium, while maintaining a high quality surface finish necessary to achieve laminar flow requirements for aircraft applications. A tensioned fabric, such as one or more woven glass fabric straps are used to apply a forming force to the part blank during a hot forming cycle. The part is conformed down onto a heated, net-shaped forming tool to achieve the required final part contour. Tension is applied to the fabric through pneumatic, hydraulic or other mechanical force generators acting on the edges of the fabric blanket. The need for bagging film is eliminated, and deterioration of thermal blankets used to maintain part temperatures is reduced or eliminated. The method substantially reduces labor and recurring consumable costs, while reducing cycle times and increasing production rates.

According to one disclosed embodiment, a method is provided of hot forming a metal part. The method comprises placing a metal part blank on a forming tool, placing a fabric over the forming tool overlying the metal part blank, and heating the metal part blank to a temperature sufficient to allow forming of the metal part blank. The method also includes applying a forming pressure to the metal part blank that forms the metal part blank over the forming tool, including applying a force to the metal part blank using the fabric. The method may also comprise installing at least one thermal blanket over the forming tool covering the metal part blank and the fabric. Placing the fabric over the forming tool includes at least partially wrapping a plurality of fabric straps over the forming tool overlying the metal part blank. Placing the fabric may also include placing the fabric straps in side-by-side relationship, distributed along a dimension of the metal part blank. Applying a force to the fabric includes applying a force to opposite ends of each of the fabric straps. Applying the force to opposite ends of each of the fabric straps is performed using one of pneumatic cylinders, hydraulic cylinders, mechanical force generating mechanisms and electronic motors. The method may also include sensing the force applied to the fabric strap, generating a feedback signal, and adjusting the force applied to the fabric strap using the feedback signal.

According to another disclosed embodiment, a method is provided for making a perforated metal airfoil skin. The method comprises placing a perforated metal sheet on a forming tool, and installing at least one fabric strap over the forming tool covering the perforated metal sheet. The method also includes heating the forming tool to a temperature sufficient to allow hot forming of the perforated metal sheet, and applying forming pressure to the perforated metal sheet by applying a force to the fabric strap that draws the fabric strap against the forming tool. The method may further comprise pre-forming the perforated metal sheet into a shape generally matching a surface of the forming tool. The method may also include installing a plurality of fabric straps on the forming tool overlying the perforated metal sheet, including arranging the fabric straps side-by-side and distributed along a dimension of the perforated metal sheet. In some variations, the method may also include coupling a force generator to the fabric strap, and applying the force to the fabric strap may be performed by the force generator. Installing the fabric strap may include wrapping the fabric strap at least partially around the tool. The fabric strap includes first and second opposite ends, and applying the force to the fabric strap includes tensioning the fabric strap by pulling on the first and second opposite ends of the fabric strap.

According to still another disclosed embodiment, apparatus is provided for hot forming a metal part blank. The apparatus includes a forming tool configured to be heated. The forming tool is adapted to have the metal part blank placed thereon. At least one fabric strap overlies the metal part blank and at least partially wraps around the forming tool. The apparatus further includes force generators coupled with the fabric strap for generating a force that draws the fabric strap against the tool and causes the fabric strap to force the metal part blank to conform to the tool surface. The fabric strap includes first and second opposite ends, and the force generators are respectively coupled with the first and second opposite ends of the fabric strap. The fabric strap may stretchable and may comprise a woven material. The stretchable material may be woven, such as twill weave. The fabric strap may comprise woven glass fibers. The apparatus may further include at least one force sensor for sensing the force applied to the fabric strap by the force generator, and a controller coupled with a force sensor and the force generator for controlling the force applied to the fabric strap through the hot forming process. The metal part blank has a width dimension, and the fabric strap has a width extending substantially across the entire width dimension of the metal part blank. The force generator comprises one of a pneumatic cylinder, a hydraulic cylinder, or a mechanical mechanism. The apparatus may also include first and second connectors for coupling first and second opposite ends of the fabric strap with the force generators.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and advantages thereof, will best be understood by reference to the following detailed description of an illustrative embodiment of the present disclosure when read in conjunction with the accompanying drawings, wherein:

DETAILED DESCRIPTION

The disclosed embodiments relate to a method and apparatus for hot forming metal parts, especially where the metal parts may not be suitably formed by other techniques such as stretching, spinning or matched die forming. The disclosed embodiments are particularly well-suited for hot forming aircraft parts having stringent surface finish requirements, however it should be noted that the embodiments may be employed to form a variety of parts used in other industries and applications.

Figure 1:
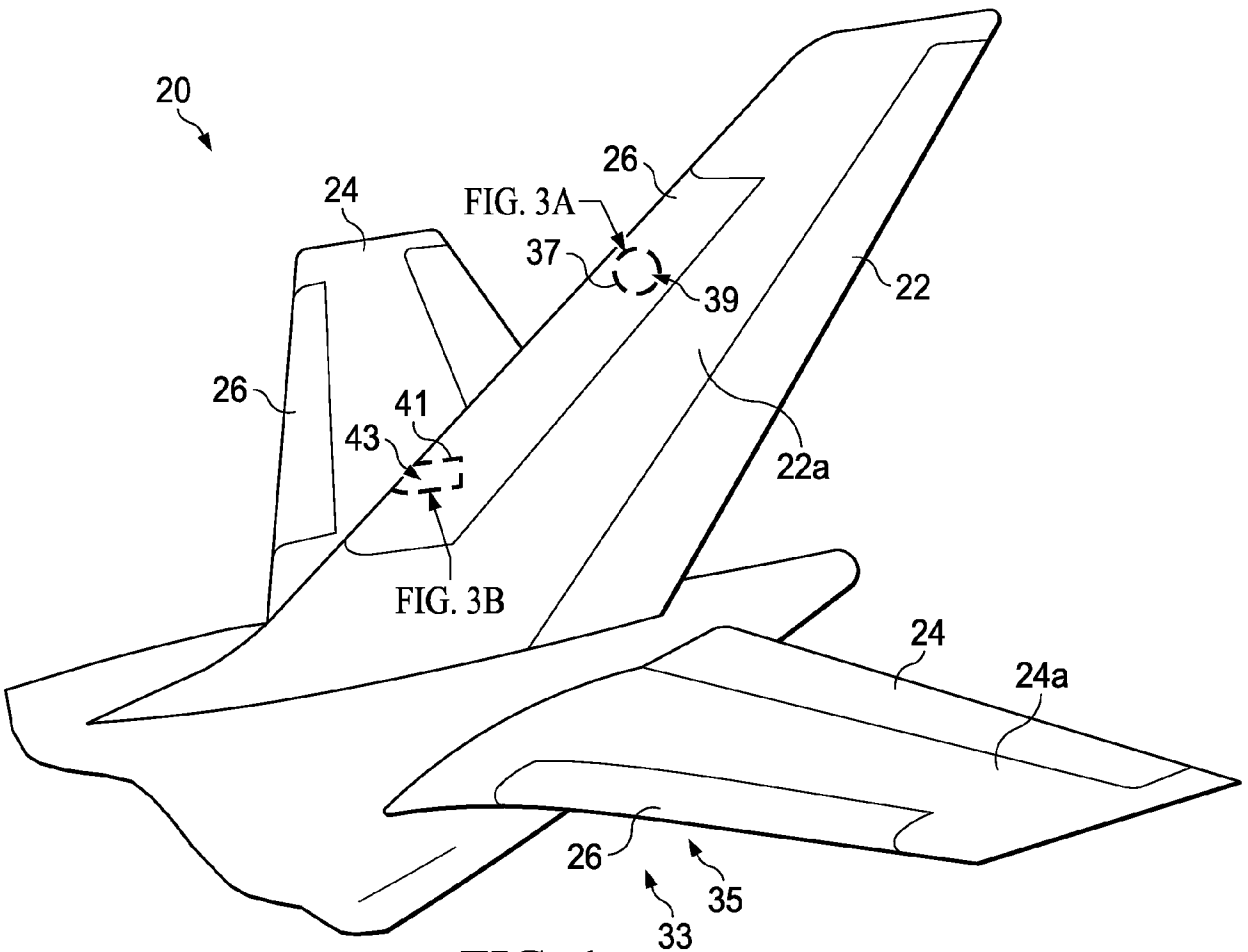
FIG. 1 is an illustration of a perspective view of an aircraft tail assembly.
Figure 2:
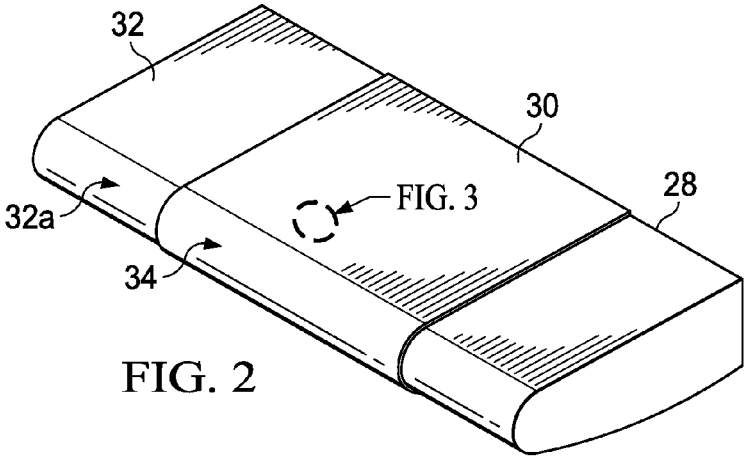
FIG. 2 is an illustration of a perspective view of a forming tool having a preformed part blank placed thereon.

Referring first to FIG. 1, an aircraft tail assembly 20 comprises a vertical stabilizer 22, and a pair of horizontal stabilizers 24. Each of the stabilizers 22, 24 includes a leading edge metal skin 26, sometimes hereinafter referred to for convenience as a metal skin 26 or a skin 26. The metal skins 26 may be formed of any metal suitable for the application, such as, without limitation, titanium. The metal skins 26 are supported by internal spars (not shown) within each of the stabilizers 22, 24. The metal skins 26 are substantially unitary in construction and have outer surfaces that transition smoothly into main skins 22*a*, 24*a* of the stabilizers 22, 24.

Figure 3A:
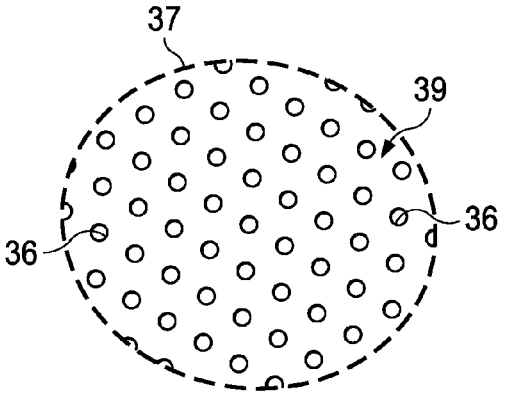
FIG. 3A is an illustration of a plan view of the area designated as "FIG. 3A" in FIGS. 1 and 2.
Figure 3B:
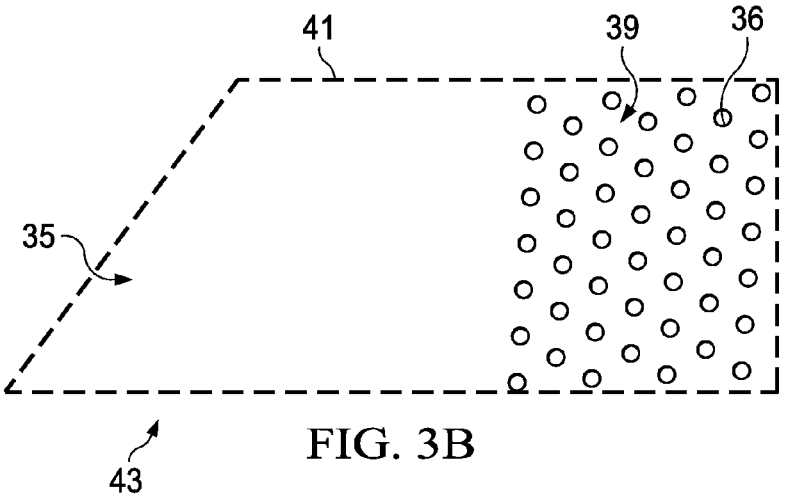
FIG. 3B is an illustration of a plan view of the area designated at FIG. 3B in FIG. 1.

In order to reduce drag on the aircraft 78 (FIG. 14), one or more sections the metal skins 26, for example the leading edges sections 33 of the horizontal stabilizers 24, may be configured to achieve natural laminar flow (NLF) 35. NLF 35 is accomplished by providing the skin sections 33 with highly smooth surface finishes, substantially free of waviness, roughness or other surface irregularities that may interrupt air flow or produce boundary layer turbulence. Alternately, sections of the leading-edge metal skins 26, such as section 37 of the vertical stabilizer 22 (FIGS. 1 and 3A), may utilize laminar flow control (LFC) 39 wherein the air layer near the surface of the metal skins 26 is drawn through small holes or perforations 36 (FIG. 3A) in the skin surface, and then vented to the atmosphere. In still other embodiments, sections of the skins 26, such as section 41 (FIGS. 1 and 3B) of the vertical stabilizer 22, may be configured to utilize both NLF 35 and LFC 39, commonly referred to as hybrid laminar flow control (HLFC) 43.

Referring now to FIGS. 2, 3A, 4 and 5, the metal skins 26 may be hot formed by former apparatus 25, also referred to herein as a former 25. The former 25 includes a mandrel-like, net-shaped forming tool 28 having a tool surface 32 that is configured to match the geometry of the leading-edge metal skins 26. The forming tool 28 may be internally heated using any suitable heating device (not shown), and includes a radiused forward edge 32*a*.

A metal sheet (not shown) having the desired thickness and surface finish is pre-formed using conventional processes, into a metal part blank 30 which is placed on the forming tool 28. Preforming of the metal part blank 30 may be achieved using any of a variety of commonly known techniques, such as by rolling a flat metal sheet into a contour generally matching the geometry of the tool surface 32. This pre-forming process results in a metal part blank 30 that generally matches, but may not completely conform to the tool surface 32. In the illustrated example, the metal part blank 30 includes perforations 36 (FIG. 3A) for laminar flow control, and may have a highly smooth surface, free of waviness and/or irregularities, in order to promote natural laminar flow over the metal skin 26. Surface finish requirements, including surface roughness and waviness, will depend upon the aircraft application and airfoil design.

Figure 5:
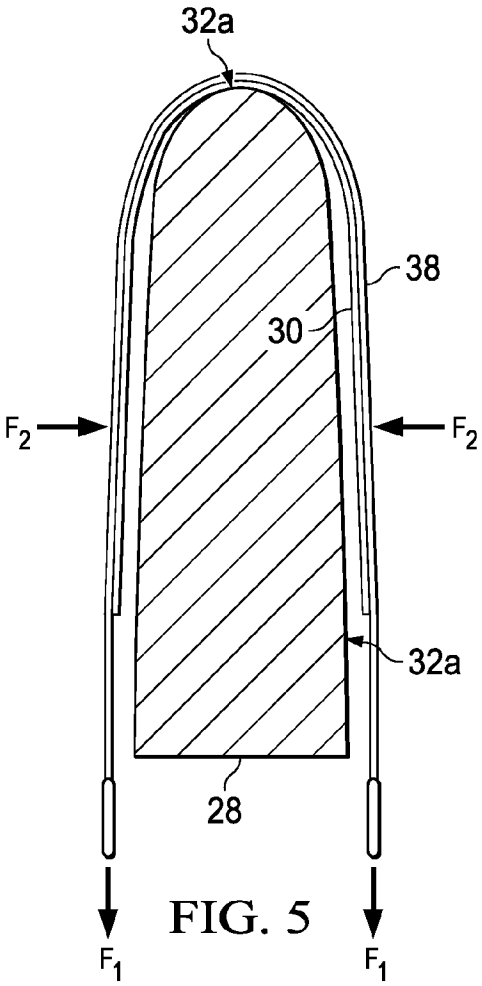
FIG. 5 is an illustration of a sectional view taken along the line 5-5 in FIG. 4.
Figure 4:
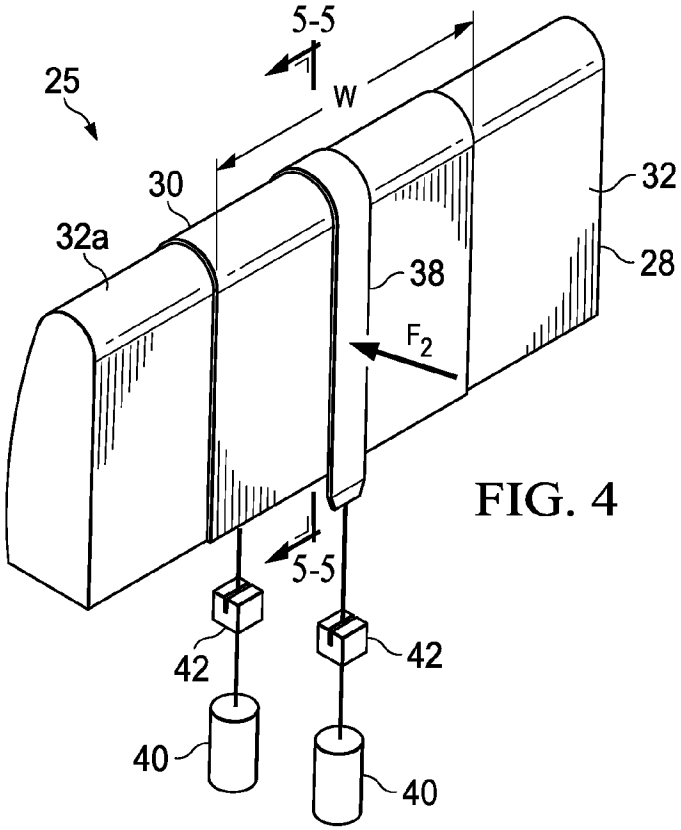
FIG. 4 is an illustration of a perspective view of former apparatus for hot forming a metal part using the forming tool shown in FIG. 2.

With the preformed metal part blank 30 having been placed on the forming tool 28, a fabric in the form of one or more fabric straps 38, is installed over the metal part blank 30. The straps 38 have a length sufficient to extend around the part blank 30 and the forming tool 28. Opposite ends of the strap 38 are coupled with force generators 40 through suitable connections 42. Referring particularly to FIGS. 4 and 5, as will be discussed later, the force generators 40 apply a tension force $F_1$ to the straps 38, drawing the straps 38 down onto the forming tool 28. As the tension or pulling force $F_1$ is applied to the opposite ends of the straps 38 by the force generators 40, the straps 38 are placed in tension. The tension in the straps 38 draws the straps 38 down onto the forming tool 28, in turn causing the straps 38 to apply forming pressure $F_2$ to the part blank 30, on opposite sides of the forming tool 28. The applied forming pressure $F_2$ causes the part blank 30 to be formed down onto, and thereby conform to the tool surface 32.

In some embodiments, a single strap 38, i.e. a single piece of fabric, spanning the entire width dimension W of the part blank 30 may be employed, while in other embodiments a plurality of the straps 38 distributed along the width dimension W in side-by-side relationship may be necessary or desirable. In the case of straps 38 that are particularly wide, such as a strap 38 that spans the entire width dimension W of the part blank 30, multiple force generators 40 may be connected along the width of the strap 38 in order to tension the strap 38 substantially uniformly along its width. In one embodiment, the straps 38 may comprise a flexible and stretchable woven fabric capable of withstanding elevated temperatures typically used for hot metal forming. The straps 38 are sufficiently stretchable to allow them to conform the metal part blank 30 down onto the tool surface 32. The straps 38 should have a substantially smooth surface finish so as to not impart surface irregularities to the part blank 30, and thereby adversely affect the smoothness and surface finish of the part blank 30.

In one embodiment, for example and without limitation, the straps 38 may comprise a multi-layered fabric wherein each layer has a twill weave, however other types of weave patterns may be possible, providing they possess a smooth surface finish that does not impart irregularities to the surface of the part blank 30. The number of layers of fabric will depend on the application, and should be sufficient to withstand the forming forces to be applied, while remaining flexible and conformable to the shape of the forming tool 28. The fabric may comprise, for example and without limitation, silica glass strands that are substantially continuous in the length direction L (FIG. 9) of the strap 38.

In an embodiment of the strap 38 employing a silica glass fabric, the strap 38 may be baked-off in an oven at elevated temperature in order to eliminate volatiles. For example, in one embodiment of the strap 38 comprising four layers of 98% silica glass fabric, volatiles in the strap 38 may be eliminated by baking it at approximately 700° F. In determining the desired length L of the strap 38, shrinking of the strap length caused by bake-off may be taken into consideration. While the illustrated straps 38 are formed of a woven fabric, it may be possible to fabricate the straps 38 from other flexible, stretchable materials having the required smooth surface finish and which are capable of withstanding the applied forces and the hot forming temperatures without degradation.

Figure 6:
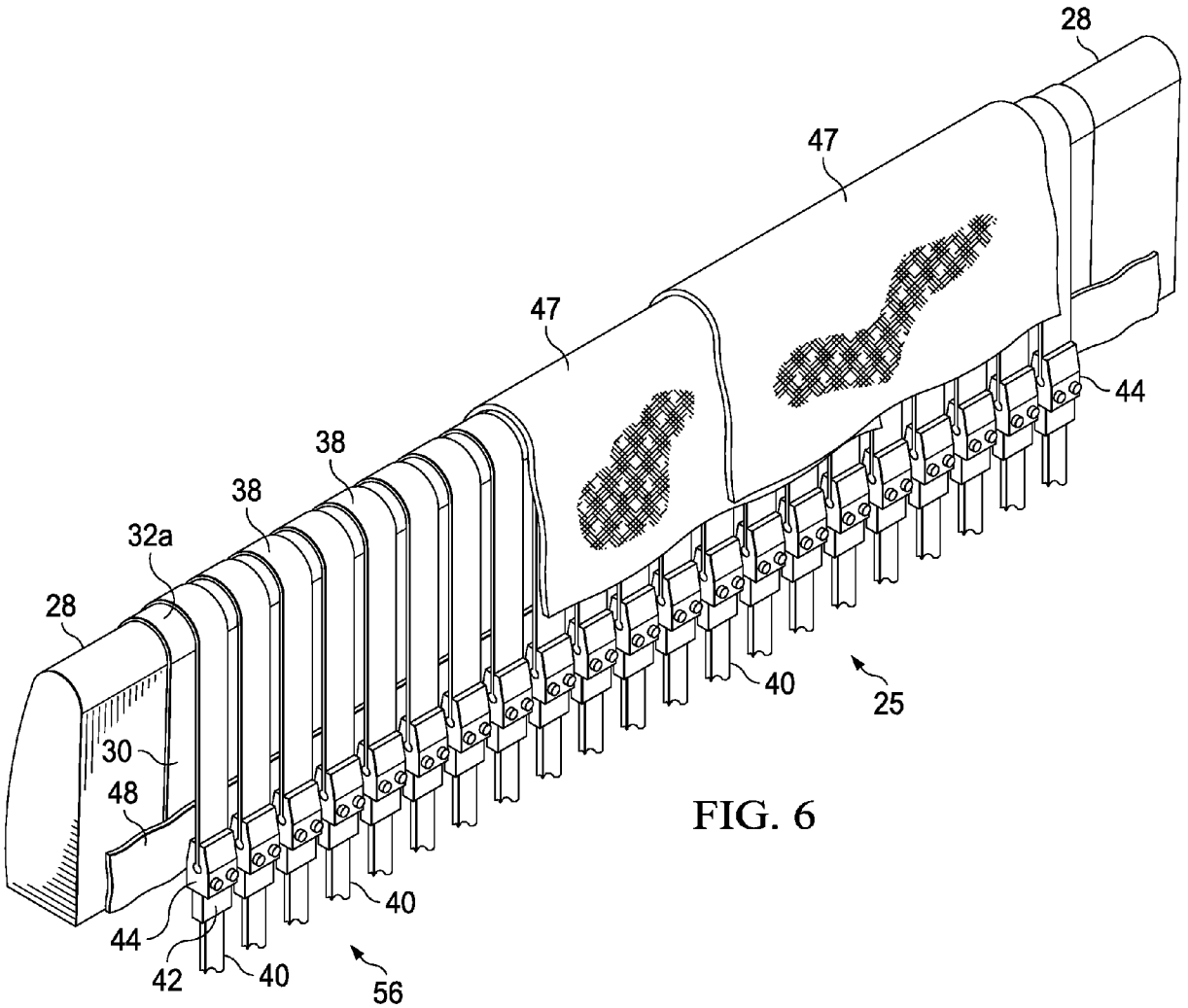
FIG. 6 is an illustration of a perspective view of an embodiment of the former apparatus shown in FIG. 4, certain of the insulation blankets having been removed to better show the use of multiple fabric straps.

FIG. 6 illustrates an embodiment of the apparatus in which a plurality of fabric straps 38 are employed to form a metal part blank 30 onto a forming tool 28. In this example, the fabric straps 38 are slightly spaced apart and generally evenly distributed along the length of the forming tool 28. In other embodiments, however, the fabric straps 38 may not be evenly distributed and/or may be substantially contiguous to each other. Opposite extremities of the fabric straps 38 are coupled with force generators 40 by connections 42 (FIG. 4) comprising clamps 44.

Figure 7:
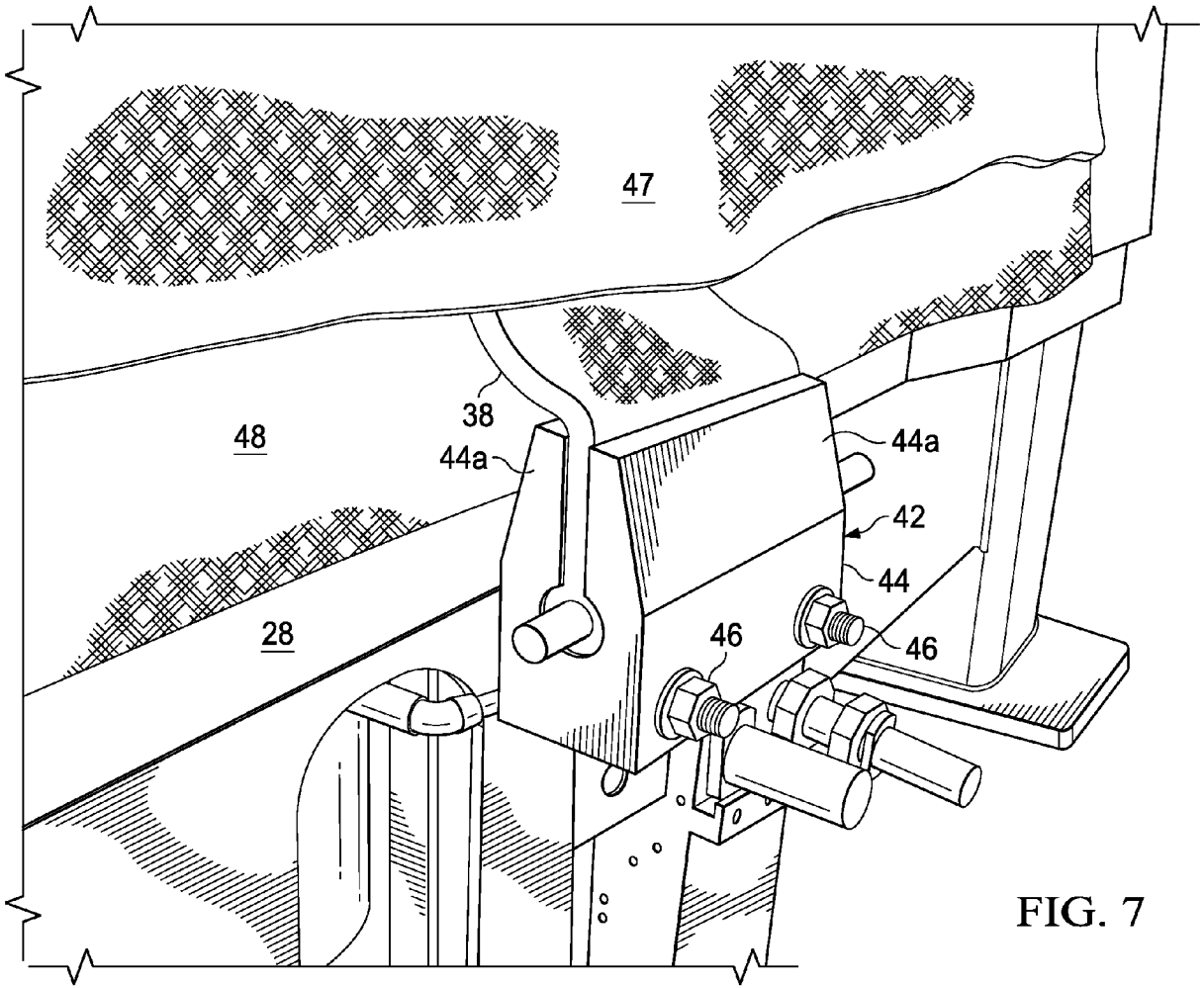
FIG. 7 is an illustration of a perspective view of a clamp attached to an end of one of the fabric straps shown in FIG. 6.

As shown in FIG. 7, each of the clamps 44 may comprise a pair of clamping jaws **44*a* between which an extremity of one of the fabric straps 38 is clamped. The jaws 44*a* are held together by threaded fasteners 46. Depending on the application and the shape of the forming tool 28, shim-like pads 48 (FIGS. 6 and 7) may be installed between the extremities of the fabric straps 38 and the forming tool 28 to close any gaps between the straps 38 and the forming tool 28, and thereby assure that even forming pressure is applied to the part blank 30. One or more thermal insulation blankets 47 may be placed over the forming tool 28, covering the straps 38 in order to retain the heat radiating from the forming tool 28, and thereby thermally insulate the part blank 30. Thus, the thermal insulation blankets 47 are located external of the fabric straps 38, and are not subjected to the forming pressure applied by the fabric straps 38. The thermal insulation blankets 47, as well as the pads 48 may be constructed of materials that are similar to or the same as those used in the fabric straps 38**.

In use, as previously indicated, a flat metal sheet is preformed into the general shape of the forming tool surface 32. The fabric straps 38 are then placed on or looped around the forming tool 28, covering the pre-formed part blank 30. The opposite extremities of the straps 38 are then coupled with the force generator 40 using clamps 44 or other means, such as D-rings 58 (FIGS. 9 and 10) described later. Pads 48 may be installed between the straps 38 and the tool 28, as necessary. Next, one or more thermal insulation blankets 47 are placed on the tool 28, covering the straps 38 and the part blank 30.

The forming tool 28 is then heated by any suitable means, such as by a suitable heating system (not shown) that is integrated into the forming tool 28, or by placing the forming tool 28 in an oven (not shown). The forming tool 28 is heated to the forming temperature of the part blank 30. For example, and without limitation, in the case of a titanium part blank 30, during a hot forming cycle, the part blank 30 may be subjected to a temperature of approximately 1000° F. for approximately 30 minutes. Heating of the metal part blank 30 substantially reduces residual stresses in the part blank 30, allowing the part blank 30 relax and permit forming. The force generators 40 apply a tension force $F_1$ (FIG. 5) to the fabric straps 38 which causes the part blank 30 to be formed down against and conform to the tool surface 32. The tension force $F_1$ applied by the force generators 40 may be adjusted as the forming tool 28 part blank 30 heats up in order to maintain a constant forming pressure $F_2$ on the part blank 30. When the forming process is complete, the part blank 30 is allowed to cool, following which the thermal insulation blankets 47 and the fabric straps 38 are removed, allowing the fully formed part to be removed from the forming tool 28.

Figure 8:
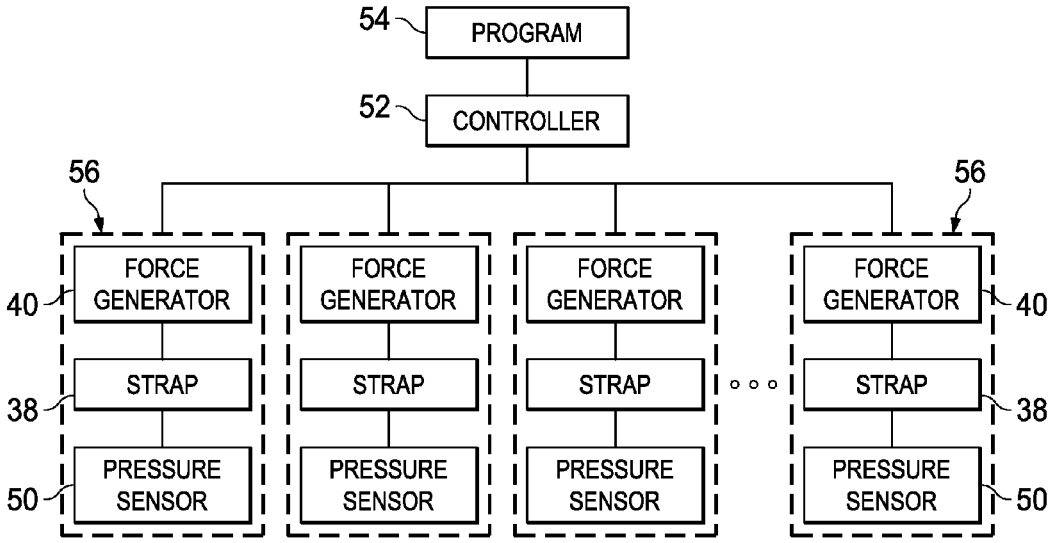
FIG. 8 is an illustration of a block diagram showing control components of the former apparatus.

The hot forming process described above using fabric straps 38 to apply forming pressure to a part blank may be at least partially automated. For example, referring to FIG. 8, one or more formers 56 may be independently and automatically operated by a controller 52. The controller 52 may be a PC (personal computer) or a PLC (programmable logic controller), and controls the operation of the formers 56 according to a set of instructions forming part of a software program 54. Each of the formers 56 may include one of the previously described fabric straps 38, a force generator 40 and optionally, a pressure sensor 50 for sensing the pressure applied to the strap 38 by the force generator 40.

As previously mentioned, the force generator 40 may comprise a pneumatic cylinder, a hydraulic cylinder, an electric motor or similar controllable mechanism for tensioning the strap 38. The pressure sensor 50 may be integrated into the strap 38, or may comprise a discrete force sensor that is coupled between the force generator and the strap 38. The pressure sensor 50 senses the tension force $F_1$ being applied to the strap 38 and sends a feedback signal to the controller 52 which is used to control the associated force generator 40. The controller 52 may separately control and/or coordinate the operation of the force generators 40 to apply a predetermined level of force to each of the fabric straps 38.

In some embodiments, depending upon the instructions contained in the software program 54, the controller 52 may individually control the force generators 40, such that differing ones of the formers 56 apply differing levels of forming force to the part blank along the length of the forming tool 28. In other embodiments, the controller 52 may individually control the force generators 40 such that the formers 25 operate in a predetermined sequence, whereby different sections of the part blank 30 are sequentially formed. For example, the force generators 40 may be controlled such that forming of the part blank 30 begins near the middle of the part blank 30, and then progresses from the middle, outward toward the ends of the part blank 30.

Figure 9:
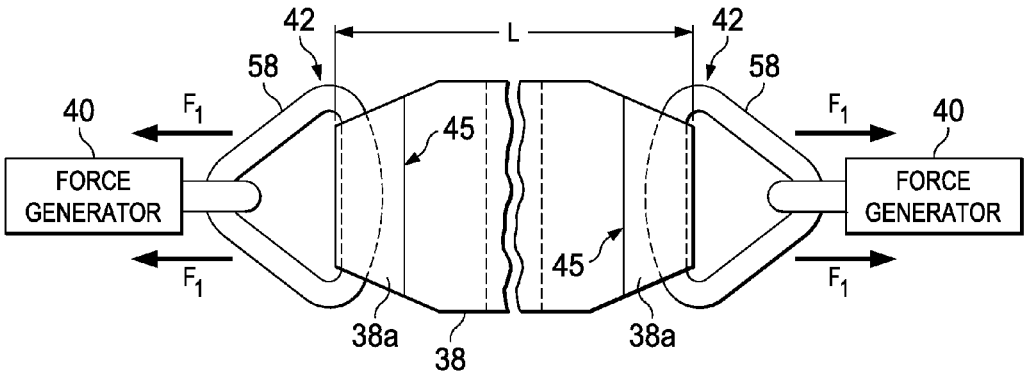
FIG. 9 is an illustration of a combined block and plan view of an alternate embodiment of the fabric strap coupled with force generators by a D-rings.
Figure 10:
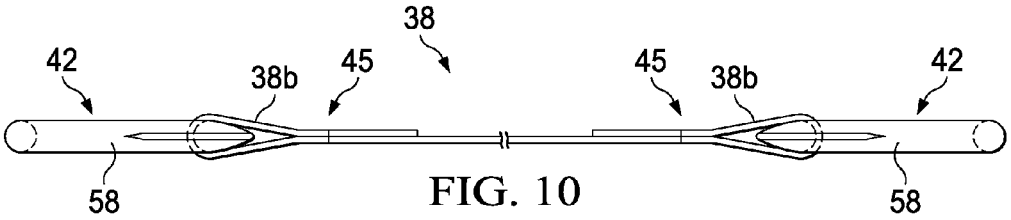
FIG. 10 is an illustration of a side view of the fabric strap shown in FIG. 8.

FIGS. 9 and 10 illustrate an alternate embodiment of the fabric strap 38 in which the connection between the force generator 40 and the strap 38 comprises a metal D-ring 58. The opposite extremities of the fabric strap 38 are folded over onto themselves and stitched together at 38 to form loops 38*a*, 38*b*. The D-rings 58 are trained through and held within the loops 38*a*, 38*b*. A pair of force generators 40 are respectively coupled with the D-rings 58 to apply a force $F_1$ that places the strap 38 in tension.

Figure 11:
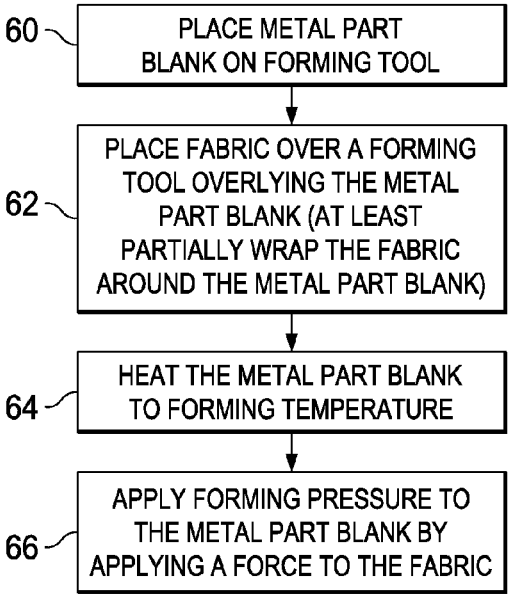
FIG. 11 is an illustration of a flow diagram of a method of hot forming a metal part.

Attention is now directed to FIG. 11 which broadly illustrates the overall steps of a method of hot forming a metal part. At 60, a metal part blank 30 is placed on a forming tool 28. At 62, a fabric is placed over the forming tool overlying the metal part blank 30. The fabric may comprise the fabric straps 38 previously described. The fabric is at least partially wrapped around the metal part blank. At 64, the metal part blank 30 is heated to a forming temperature of the metal part blank 30. At 66, a forming pressure $F_2$ is applied to the metal part blank by applying a force $F_1$ to the fabric.

Figure 12:
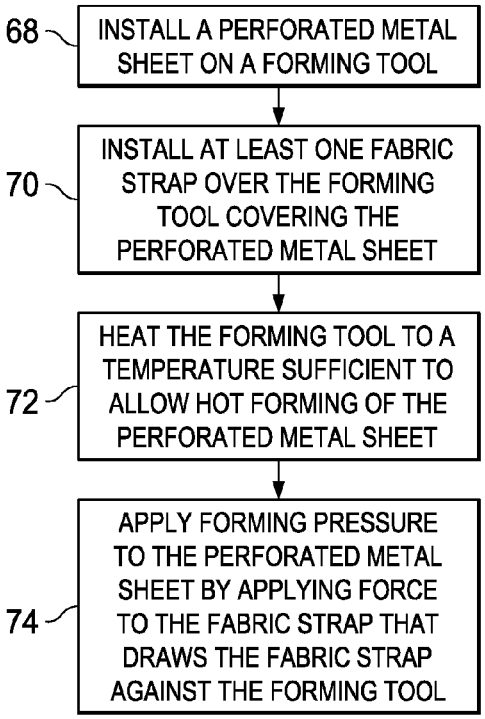
FIG. 12 is an illustration of a flow diagram of a method of making a perforated metal airfoil skin.

FIG. 12 broadly illustrates the overall steps of a method of making a perforated metal airfoil skin 26. At 68, a perforated metal sheet is installed on a forming tool 28. At 70, at least one fabric strap 38 is installed over the forming tool 28 covering the perforated metal sheet 26. At 72, the forming tool 28 is heated to a temperature sufficient to allow hot forming of the perforated metal sheet. At 74, forming pressure $F_2$ is applied to the perforated metal sheet by applying a force $F_1$ to the fabric strap 38 that draws the fabric strap 38 against the forming tool 28.

Figure 13:
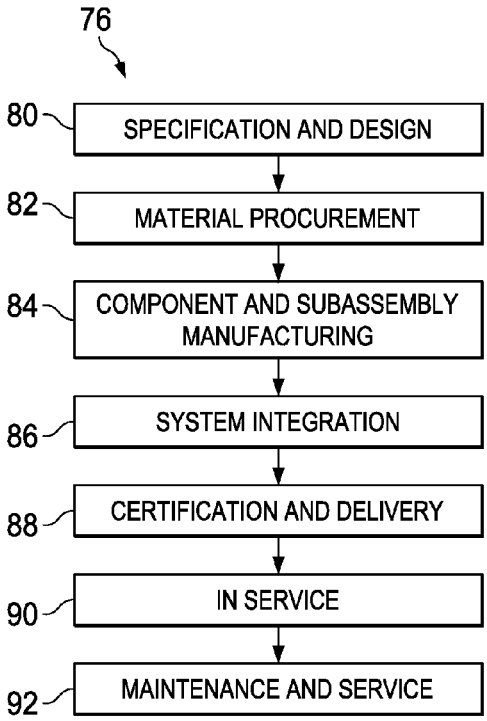
FIG. 13 is an illustration of a flow diagram of aircraft production and service methodology; and, FIG. 14 is an illustration of a block diagram of an aircraft.
Figure 14:
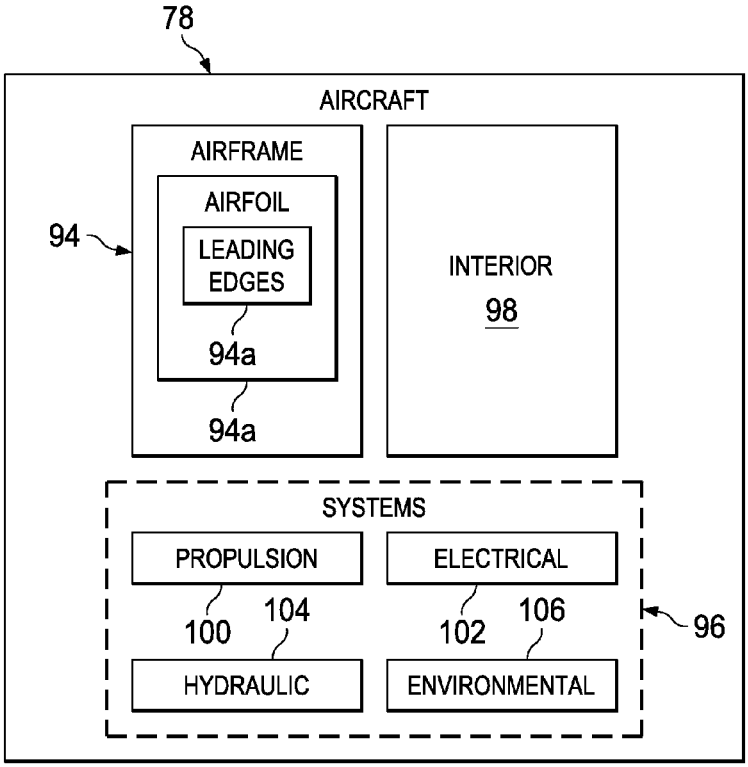

Embodiments of the disclosure may find use in a variety of potential applications, particularly in the transportation industry, including for example, aerospace, marine, automotive applications and other application where metal parts, such as shaped airfoil skins, may be used. Thus, referring now to FIGS. 13 and 14, embodiments of the disclosure may be used in the context of an aircraft manufacturing and service method 76 as shown in FIG. 13 and an aircraft 78 as shown in FIG. 14. Aircraft applications of the disclosed embodiments may include, for example, without limitation, skins and other shaped metal parts. During pre-production, exemplary method 76 may include specification and design 80 of the aircraft 78 and material procurement 82. During production, component and subassembly manufacturing 84 and system integration 86 of the aircraft 78 takes place. Thereafter, the aircraft 78 may go through certification and delivery 88 in order to be placed in service 90. While in service by a customer, the aircraft 78 is scheduled for routine maintenance and service 92, which may also include modification, reconfiguration, refurbishment, and so on.

Each of the processes of method 76 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 14, the aircraft 78 produced by exemplary method 76 may include an airframe 94 with a plurality of systems 96 and an interior 98. The airframe 94 may include airfoils 94*a* such as wings and stabilizers (not shown), each of which may have a leading edge 94*b*. Examples of high-level systems 96 include one or more of a propulsion system 100, an electrical system 102, a hydraulic system 104 and an environmental system 106. Any number of other systems may be included. Although an aerospace example is shown, the principles of the disclosure may be applied to other industries, such as the marine and automotive industries.

Systems and methods embodied herein may be employed during any one or more of the stages of the production and service method 76. For example, components or subassemblies corresponding to production process 84 may be fabricated or manufactured in a manner similar to components or subassemblies produced while the aircraft is in service. Also, one or more apparatus embodiments, method embodiments, or a combination thereof may be utilized during the production stages 84 and 86, for example, by substantially expediting assembly of or reducing the cost of an aircraft 78. Similarly, one or more of apparatus embodiments, method embodiments, or a combination thereof may be utilized while the aircraft 78 is in service, for example and without limitation, to maintenance and service 92.

As used herein, the phrase "at least one of", when used with a list of items, means different combinations of one or more of the listed items may be used and only one of each item in the list may be needed. For example, "at least one of item A, item B, and item C" may include, without limitation, item A, item A and item B, or item B. This example also may include item A, item B, and item C or item B and item C. The item may be a particular object, thing, or a category. In other words, at least one of means any combination items and number of items may be used from the list but not all of the items in the list are required.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different advantages as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. Apparatus for hot forming a metal part blank, comprising:

a forming tool configured to be heated and adapted to have the metal part blank placed thereon;

at least one fabric strap overlying the metal part blank and at least partially wrapped around the forming tool;

a force generator coupled with the fabric strap for generating a force that draws the fabric strap against the forming tool and causes the fabric strap to force the metal part blank to conform to the forming tool;

a force sensor for sensing the force applied to the fabric strap by the force generator; and a controller coupled with the force sensor and the force generator for controlling the force generator based on the force sensed by the force sensor.

2. The apparatus of claim 1, wherein:

the fabric strap includes first and second opposite ends, and the force generator comprises force generators respectively coupled with the first and second opposite ends of the fabric strap.

3. The apparatus of claim 1, wherein the fabric strap is formed of a stretchable material.

4. The apparatus of claim 3, wherein the stretchable material is woven.

5. The apparatus of claim 4, wherein the stretchable material includes a twill weave.

6. The apparatus of claim 3, wherein the stretchable material includes woven glass fibers.

7. The apparatus of claim 1, wherein:

the metal part blank has a width dimension, and the fabric strap has a width extending across the width dimension of the metal part blank.

8. The apparatus of claim 1, wherein the force generator comprises one of:

a pneumatic cylinder, a hydraulic cylinder, and a mechanical mechanism.

9. The apparatus of claim 8, further comprising:

first and second connectors for coupling first and second opposite ends of the fabric strap with the force generator.

10. A method of hot forming a metal part, comprising:

placing a metal part blank on a forming tool of an apparatus, wherein the forming tool is configured to be heated and adapted to have the metal part blank placed thereon;

placing at least one fabric strap over the forming tool overlying the metal part blank and at least partially wrapped around the forming tool;

applying a force to the metal part blank using a force generator coupled with the fabric strap that draws the fabric strap against the forming tool and causes the fabric strap to force the metal part blank to conform to the forming tool;

sensing the force applied to the fabric strap by the force generator using a force sensor;

controlling, by a controller coupled with the force sensor and the force generator, the force applied to the fabric strap by the force generator based on the force sensed by the force sensor; and heating the metal part blank to a temperature sufficient to allow forming of the metal part blank.

11. The method of claim 10, further comprising:

installing at least one thermal blanket over the forming tool covering the metal part blank and the fabric strap.

12. The method of claim 10, further comprising at least partially wrapping a plurality of fabric straps over the forming tool overlying the metal part blank.

13. The method of claim 12, further comprising placing the plurality of fabric straps over the forming tool overlying the metal part blank, including arranging the plurality of fabric straps in side-by-side relationship distributed along a dimension of the metal part blank.

14. The method of claim 10, wherein:

applying the force to the metal part blank includes applying a force to opposite ends of the at least one fabric strap.

15. The method of claim 14, wherein applying the force to opposite ends of the at least one fabric strap is performed using one of pneumatic cylinders, hydraulic cylinders, mechanical force generating mechanisms and electronic motors.

16. The method of claim 14, further comprising:

sensing the force applied to the opposite ends of the at least one fabric strap;

generating a feedback signal; and adjusting the force applied to the opposite ends of the at least one fabric strap using the feedback signal.

17. A method for making a perforated metal airfoil skin, comprising:

placing a perforated metal sheet on a forming tool of an apparatus, wherein the forming tool is configured to be heated and adapted to have the perforated metal sheet placed thereon;

installing at least one fabric strap over the forming tool overlying the perforated metal sheet and at least partially wrapped around the forming tool;

heating the forming tool to a temperature sufficient to allow hot forming of the perforated metal sheet;

applying forming pressure to the perforated metal sheet by applying a force to the fabric strap by a force generator coupled with the fabric strap for generating the force that draws the fabric strap against the forming tool and causes the fabric strap to force the perforated metal sheet to conform to the forming tool; and controlling, by a controller coupled with the force sensor and the force generator, the force applied to the fabric strap by the force generator based on the force sensed by the force sensor.

18. The method of claim 17, further comprising:

pre-forming the perforated metal sheet into a shape generally matching a surface of the forming tool.

19. The method of claim 17, further comprising:

installing a plurality of fabric straps on the forming tool overlying the perforated metal sheet, including arranging the fabric straps side-by-side and distributed along a dimension of the perforated metal sheet.

20. The method of claim 19, further comprising:

coupling the force generator to each of the fabric straps, and wherein applying the force to the fabric straps is performed by the force generator.

21. The method of claim 17, wherein the fabric strap includes first and second opposite ends, and applying the force to the fabric strap includes tensioning the fabric strap by pulling on the first and second opposite ends of the fabric strap.

* * * * *